US011620935B2

(12) United States Patent
Xuan et al.

(10) Patent No.: US 11,620,935 B2
(45) Date of Patent: Apr. 4, 2023

(54) PIXEL CIRCUIT AND DRIVING METHOD THEREOF, DISPLAY PANEL, AND DISPLAY DEVICE

(71) Applicant: BOE TECHNOLOGY GROUP CO., LTD., Beijing (CN)

(72) Inventors: Minghua Xuan, Beijing (CN); Han Yue, Beijing (CN); Ning Cong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 85 days.

(21) Appl. No.: 16/629,097

(22) PCT Filed: Jan. 4, 2019

(86) PCT No.: PCT/CN2019/070485
§ 371 (c)(1),
(2) Date: Jan. 7, 2020

(87) PCT Pub. No.: WO2020/140287
PCT Pub. Date: Jul. 9, 2020

(65) Prior Publication Data
US 2021/0225261 A1 Jul. 22, 2021

(51) Int. Cl.
*G09G 3/32* (2016.01)

(52) U.S. Cl.
CPC ..... *G09G 3/32* (2013.01); *G09G 2300/0842* (2013.01); *G09G 2310/0259* (2013.01);
(Continued)

(58) Field of Classification Search
CPC ..... G09G 3/30; G09G 3/32; G09G 3/3208; G09G 3/3225; G09G 2300/0842;
(Continued)

(56) References Cited

U.S. PATENT DOCUMENTS

2001/0045929 A1* 11/2001 Prache ..... G09G 3/3233 345/89
2003/0227262 A1 12/2003 Kwon
(Continued)

FOREIGN PATENT DOCUMENTS

CN 1979618 A 6/2007
CN 103578426 A 2/2014
(Continued)

OTHER PUBLICATIONS

International Search Report of PCT/CN2019/070485 in Chinese, dated Sep. 29, 2019 with English translation.
(Continued)

*Primary Examiner* — Jason M Mandeville
(74) *Attorney, Agent, or Firm* — Collard & Roe, P.C.

(57) ABSTRACT

A pixel circuit and a driving method thereof, a display panel, and a display device are provided. The pixel circuit includes a light-emitting driving circuit, a storage circuit, and a data writing circuit, a first terminal of the storage circuit is respectively electrically connected to the data writing circuit and the light-emitting driving circuit, a second terminal of the storage circuit is configured to receive a control signal, and the storage circuit is configured to receive and store the first data voltage, to generate a first control voltage, that changes with time, according to the control signal and the first data voltage, and to cause the first control voltage to be applied to the light-emitting driving circuit to control a turn-on time of the light-emitting driving circuit; and the light-emitting driving circuit is configured to drive the light-emitting element to emit light under control of the first control voltage.

11 Claims, 5 Drawing Sheets

(52) U.S. Cl.
CPC . *G09G 2310/0262* (2013.01); *G09G 2310/06* (2013.01); *G09G 2330/028* (2013.01)

(58) Field of Classification Search
CPC ..... G09G 2330/028; G09G 2310/0243; G09G 2310/0251; G09G 2310/0259; G09G 2310/0262; G09G 2310/06
USPC ..... 345/212, 76
See application file for complete search history.

(56) References Cited

U.S. PATENT DOCUMENTS

2006/0022305 A1* 2/2006 Yamashita ..... G09G 3/2014 257/565
2007/0126683 A1 6/2007 Sung et al.
2009/0167649 A1* 7/2009 Ishizuka ..... G09G 3/3258 345/80
2010/0283777 A1* 11/2010 Sang ..... G09G 3/3696 345/212
2014/0132589 A1* 5/2014 Min ..... G09G 3/3233 345/212
2015/0179101 A1* 6/2015 Ohara ..... G09G 3/3233 345/76
2018/0175134 A1 6/2018 Kim et al.

FOREIGN PATENT DOCUMENTS

CN 107481662 A 12/2017
CN 107993609 A 5/2018
CN 108320700 A 7/2018

OTHER PUBLICATIONS

Notice of Transmittal of the International Search Report of PCT/CN2019/070485 in Chinese, dated Sep. 30, 2019.
Written Opinion of the International Searching Authority of PCT/CN2019/070485 in Chinese, dated Sep. 30, 2019.
Second Chinese Office Action in Chinese Application No. 201980000048.3 dated Jul. 5, 2021 with English translation.
English translation of the Written Opinion of the International Searching Authority of PCT/CN2019/070485, dated Sep. 30, 2019.

* cited by examiner

PIXEL CIRCUIT AND DRIVING METHOD THEREOF, DISPLAY PANEL, AND DISPLAY DEVICE

CROSS REFERENCE TO RELATED APPLICATIONS

This application is the National Stage of PCT/CN2019/070485 filed on Jan. 4, 2019, the disclosure of which is incorporated by reference.

TECHNICAL FIELD

Embodiments of the present disclosure relate to a pixel circuit and a driving method thereof, a display panel, and a display device.

BACKGROUND

Micro LED (light-emitting diode) display technology is a technology which can make LED structure design thin, miniaturize, and array, so that the Micro LED can be set on a circuit substrate to achieve a display function. Micro LED light-emitting elements have characteristics, such as low driving voltage, ultra-high brightness, long life, low power consumption, high temperature resistance, etc., therefore, the Micro LED display technology is considered as one of display panel technologies in a next generation. The Micro LED display technology has a wide range of applications. When the Micro LED display technology is applied to smart phones and wearable devices, the Micro LED display technology can extend an endurance capability of a battery, reduce power consumption, and improve display brightness, etc., and can also solve problems of whitening and poor identification of images displayed on a display device caused by strong ambient light.

SUMMARY

Some embodiments of the present disclosure provide a pixel circuit, the pixel circuit includes a light-emitting driving circuit, a storage circuit, and a data writing circuit, a first terminal of the storage circuit is respectively electrically connected to the data writing circuit and the light-emitting driving circuit, a second terminal of the storage circuit is configured to receive a control signal, and the storage circuit is configured to receive and store a first data voltage transmitted by the data writing circuit, to generate a first control voltage, that changes with time, according to the control signal and the first data voltage, and to cause the first control voltage to be applied to the light-emitting driving circuit to control a turn-on time of the light-emitting driving circuit; and the light-emitting driving circuit is configured to drive a light-emitting element to emit light under control of the first control voltage.

For example, in the pixel circuit provided by some embodiments of the present disclosure, the second terminal of the storage circuit is electrically connected to a control voltage terminal, and the control voltage terminal is configured to output the control signal that changes with time.

For example, in the pixel circuit provided by some embodiments of the present disclosure, the control signal is a triangular wave signal, a sawtooth wave signal, or a sine wave signal.

For example, in the pixel circuit provided by some embodiments of the present disclosure, the storage circuit comprises a capacitor.

For example, in the pixel circuit provided by some embodiments of the present disclosure, the second terminal of the storage circuit is electrically connected to a control voltage terminal, and the control voltage terminal is configured to output the control signal, and the control signal is a square wave signal.

For example, in the pixel circuit provided by some embodiments of the present disclosure, the storage circuit comprises a capacitor and a signal conversion sub-circuit, the first terminal of the storage circuit comprises a first electrode of the capacitor, the second terminal of the storage circuit comprises a second terminal of the signal conversion sub-circuit, a second electrode of the capacitor is connected to a first terminal of the signal conversion sub-circuit, the signal conversion sub-circuit is configured to convert the control signal into an intermediate control signal that changes with time, and the capacitor is configured to generate the first control voltage according to the intermediate control signal and the first data voltage.

For example, in the pixel circuit provided by some embodiments of the present disclosure, the light-emitting driving circuit comprises a driving transistor, a first electrode of the driving transistor is electrically connected to a first power terminal, a second electrode of the driving transistor is electrically connected to a first terminal of the light-emitting element, and a gate electrode of the driving transistor is respectively electrically connected to the data writing circuit and the storage circuit.

For example, in the pixel circuit provided by some embodiments of the present disclosure, the data writing circuit comprises a data writing transistor, a first electrode of the data writing transistor is electrically connected to a data line, a second electrode of the data writing transistor is electrically connected to the storage circuit, and a gate electrode of the data writing transistor is electrically connected to a scanning signal line to receive a scanning signal.

For example, the pixel circuit provided by some embodiments of the present disclosure further includes: a light-emitting control circuit; the light-emitting control circuit is configured to control the light-emitting driving circuit to drive the light-emitting element to emit light under control of a light-emitting control signal.

For example, in the pixel circuit provided by some embodiments of the present disclosure, the light-emitting control circuit comprises a first light-emitting control transistor and a second light-emitting control transistor, a first electrode of the first light-emitting control transistor is electrically connected to the first power terminal, a second electrode of the first light-emitting control transistor is electrically connected to the first electrode of the driving transistor, and a gate electrode of the first light-emitting control transistor is electrically connected to a light-emitting control line to receive the light-emitting control signal; and a first electrode of the second light-emitting control transistor is electrically connected to the second electrode of the driving transistor, a second electrode of the second light-emitting control transistor is electrically connected to the first terminal of the light-emitting element, and a gate electrode of the second light-emitting control transistor is electrically connected to the light-emitting control line to receive the light-emitting control signal.

For example, the pixel circuit provided by some embodiments of the present disclosure further includes: a light-emitting control circuit; the light-emitting driving circuit comprises a driving transistor, the data writing circuit comprises a data writing transistor, the light-emitting control circuit comprises a first light-emitting control transistor and a second light-emitting control transistor, the storage circuit comprises a capacitor, a first electrode of the data writing transistor is electrically connected to a data line, a second electrode of the data writing transistor is electrically connected to a first electrode of the capacitor, and a gate electrode of the data writing transistor is electrically connected to a scanning signal line to receive a scanning signal; a second electrode of the capacitor is configured to receive the control signal, and the control signal is a triangular wave signal, a sawtooth wave signal, or a sine wave signal; a first electrode of the driving transistor is electrically connected to a first power terminal, a second electrode of the driving transistor is electrically connected to a first terminal of the light-emitting element, and a gate electrode of the driving transistor is respectively electrically connected to the second electrode of the data writing transistor and the first electrode of the capacitor; a first electrode of the first light-emitting control transistor is electrically connected to the first power terminal, a second electrode of the first light-emitting control transistor is electrically connected to the first electrode of the driving transistor, and a gate electrode of the first light-emitting control transistor is electrically connected to a light-emitting control line to receive a light-emitting control signal; a first electrode of the second light-emitting control transistor is electrically connected to the second electrode of the driving transistor, a second electrode of the second light-emitting control transistor is electrically connected to the first terminal of the light-emitting element, and a gate electrode of the second light-emitting control transistor is electrically connected to the light-emitting control line to receive the light-emitting control signal; and a second terminal of the light-emitting element is electrically connected to a second power terminal.

For example, in the pixel circuit provided by some embodiments of the present disclosure, the light-emitting element is a light-emitting diode, and a size of the light-emitting diode is less than 100 microns.

Some embodiments of the present disclosure provide a driving method applied to the pixel circuit according to any one of the above embodiments, one frame time includes a first data writing phase and a first light-emitting phase, and the driving method includes: in the first data writing phase, writing the first data voltage to the storage circuit; and in the first light-emitting phase, writing the control signal to the storage circuit, generating, by the storage circuit, the first control voltage that changes with time according to the control signal and the first data voltage, and driving the light-emitting element to emit light under control of the first control voltage.

For example, in the driving method provided by some embodiments of the present disclosure, the one frame time further comprises a second data writing phase and a second light-emitting phase, and the driving method further comprises: in the second data writing phase, writing a second data voltage to the storage circuit; and in the second light-emitting phase, writing the control signal to the storage circuit, and generating, by the storage circuit, a second control voltage that changes with time according to the control signal and the second data voltage, and driving the light-emitting element to emit light under control of the second control voltage.

For example, in the driving method provided by some embodiments of the present disclosure, the first data voltage is different from the second data voltage.

For example, in the driving method provided by some embodiments of the present disclosure, a light-emitting time of the light-emitting element in the first light-emitting phase is different from a light-emitting time of the light-emitting element in the second light-emitting phase.

For example, in the driving method provided by some embodiments of the present disclosure, the light-emitting driving circuit comprises a driving transistor, a first electrode of the driving transistor is electrically connected to a first power terminal, a second electrode of the driving transistor is electrically connected to a first terminal of the light-emitting element, and a gate electrode of the driving transistor is respectively electrically connected to the data writing circuit and the storage circuit, the control signal includes a maximum value and a minimum value, the driving transistor is a P-type transistor, and the maximum value and the minimum value satisfy a following relational expression:

$$V_{data1}-V_{e1}+V_{e2}<V_{dd}+V_{th}$$

where $V_{data1}$ represents the first data voltage, $V_{e1}$ represents the maximum value, $V_{e2}$ represents the minimum value, $V_{dd}$ represents a first power voltage output from the first power terminal, and $V_{th}$ represents a threshold voltage of the driving transistor.

For example, in the driving method provided by some embodiments of the present disclosure, the light-emitting driving circuit comprises a driving transistor, a first electrode of the driving transistor is electrically connected to a first power terminal, a second electrode of the driving transistor is electrically connected to a first terminal of the light-emitting element, and a gate electrode of the driving transistor is respectively electrically connected to the data writing circuit and the storage circuit, the control signal includes a maximum value and a minimum value, the driving transistor is an N-type transistor, and the maximum value and the minimum value satisfy a following relational expression:

$$V_{data1}-V_{e2}+V_{e1}<V_{dd}+V_{th}$$

where $V_{data1}$ represents the first data voltage, $V_{e1}$ represents the maximum value, $V_{e2}$ represents the minimum value, $V_{dd}$ represents a first power voltage output from the first power terminal, and $V_{th}$ represents a threshold voltage of the driving transistor.

Some embodiments of the present disclosure also provide a display device, comprising the pixel circuit according to any one of the above embodiments.

BRIEF DESCRIPTION OF THE DRAWINGS

In order to clearly illustrate the technical solutions of the embodiments of the present disclosure, the drawings of the embodiments will be briefly described in the following; and it is obvious that the described drawings are only related to some embodiments of the present disclosure and thus are not limitative to the present disclosure.

DETAILED DESCRIPTION

Figure 1:
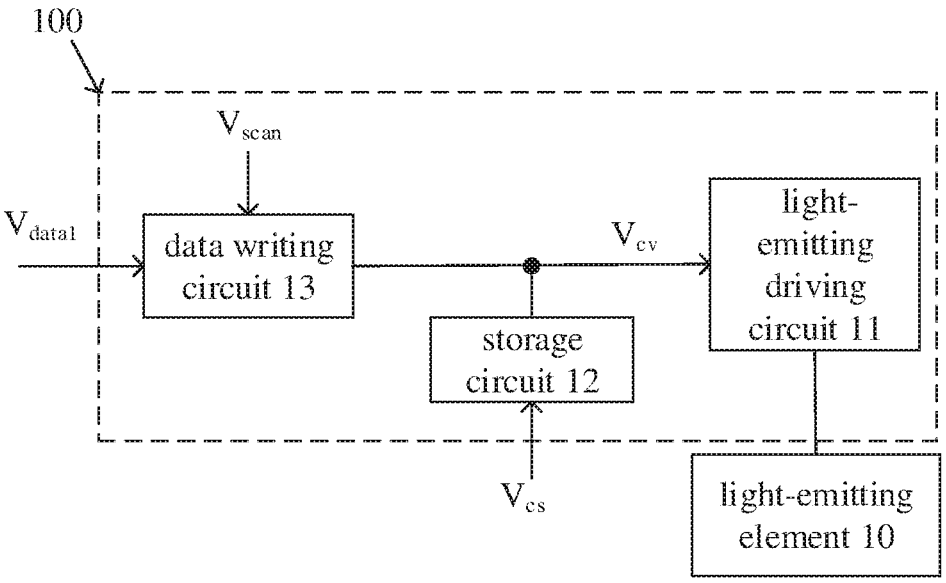
FIG. 1 is a schematic block diagram of a pixel circuit provided by some embodiments of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "comprise," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may comprise an electrical connection, directly or indirectly. "On," "under," "right," "left" and the like are only used to indicate relative position relationship, and when the position of the object which is described is changed, the relative position relationship may be changed accordingly.

In order to keep the following description of embodiments of the present disclosure clear and concise, detailed descriptions of some known functions and known components are omitted in the present disclosure.

Micro LED (μ-LED) technology is a technology to miniaturize and matrix LEDs. In brief, the Micro LED (μ-LED) technology is a technology to film, miniaturize and array LEDs, and can achieve to address each LED pixel unit independently, and drive each LED pixel unit to emit light independently. The Micro LED technology has characteristics, such as high efficiency, high brightness, high reliability and fast reaction time, and the like, of inorganic LED, also has characteristics, such as self-luminescence without backlight source, small volume, light weight, etc. The Micro LED technology can also easily achieve the effect of saving energy, and may be installed on a circuit substrate by transfer printing and other methods. However, due to problems, such as a driving circuit provided on a glass substrate, color coordinate deviation at different currents, and the like, it is difficult to achieve the commercialization of Micro LED display panels.

At least some embodiments of the present disclosure provide a pixel circuit and a driving method thereof, a display panel, and a display device, the pixel circuit can control gray scales, under a fixed voltage, by controlling the light-emitting time of a Micro LED serving as a light-emitting element, i.e., a display driving scheme for displaying more gray scales can be achieved by matching the fixed voltage with a control voltage (e.g., a first control voltage and a second control voltage) that changes with time, thereby solving the problems of color coordinate deviation of Micro LED light-emitting elements under different currents, and the pixel circuit can control the light-emitting time of the Micro LED without adding additional elements, and has a simple structure and low cost.

It should be noted that the transistors used in the embodiments of the present disclosure can all be thin film transistors, field effect transistors, or other switching devices with the same characteristics. A source electrode and a drain electrode of a transistor used here may be symmetrical in structure, so the source electrode and the drain electrode of the transistor can be structurally indistinguishable. In the embodiment of the present disclosure, in order to distinguish the two electrodes of the transistor except a gate electrode of the transistor, one electrode of the two electrodes is directly described to be a first electrode, and the other electrode of the two electrodes is directly described to be a second electrode, so the first electrode and the second electrode of all or part of the transistors in the embodiments of the present disclosure are interchangeable as required. For example, the first electrode of the transistor described in the embodiment of the present disclosure may be a source electrode, and the second electrode of the transistor may be a drain electrode; alternatively, the first electrode of the transistor may be a drain electrode, and the second electrode of the transistor may be a source electrode.

According to characteristics of transistors, transistors can be divided into N-type transistors (N-type MOS transistors) and P-type transistors (P-type MOS transistors). For the sake of clarity, the embodiments of the present disclosure take a case that the transistors are P-type transistors as an example to elaborate the technical scheme of the present disclosure. However, the transistors of the embodiments of the present disclosure are not limited to be P-type transistors, and those skilled in the art can also use N-type transistors to achieve the functions of one or more transistors in the embodiments of the present disclosure according to actual needs.

Embodiments of the present disclosure will be described in detail below with reference to the accompanying drawings, but the present disclosure is not limited to these specific embodiments.

FIG. 1 is a schematic block diagram of a pixel circuit provided by some embodiments of the present disclosure.

For example, as shown in FIG. 1, the pixel circuit 100 includes a light-emitting driving circuit 11, a storage circuit 12, and a data writing circuit 13. The storage circuit 12 includes a first terminal and a second terminal, the first terminal of the storage circuit 12 is respectively electrically connected to the data writing circuit 13 and the light-emitting driving circuit 11, the second terminal of the storage circuit 12 is configured to receive a control signal $V_{cs}$, the storage circuit 12 is configured to receive and store a first data voltage $V_{data1}$ transmitted by the data writing circuit 13, to generate a first control voltage $V_{cv}$, that changes with time, according to the control signal $V_{cs}$ and the first data voltage $V_{data1}$, and to cause the first control voltage $V_{cv}$ to be applied to the light-emitting driving circuit 11 to control a turn-on time of the light-emitting driving circuit 11; and the light-emitting driving circuit 11 is configured to drive the light-emitting element 10 to emit light under control of the first control voltage $V_{cv}$.

For example, the data writing circuit 13 is configured to write the first data voltage $V_{data1}$ into the storage circuit 12 under control of a scanning signal $V_{scan}$.

For example, in a case where the light-emitting driving circuit 11 is turned on, the light-emitting element 10 can be driven to emit light, that is, without considering the error, the turn-on time of the light-emitting driving circuit 11 is identical to the light-emitting time of the light-emitting element 10. A value (gray scale) of the display brightness of the light-emitting element 10 can be controlled by controlling a length of the light-emitting time of the light-emitting element 10 within one frame time, so that the light-emitting element 10 displays more gray scales. For example, if the light-emitting time of the light-emitting element 10 is longer in each frame time, the display brightness of the light-emitting element 10 is higher, that is, a level of the gray scale corresponding to the light-emitting element 10 is larger.

For example, the light-emitting element 10 is a light-emitting diode, for example, an inorganic light-emitting diode. A size of the light-emitting diode is less than 100 microns, for example, 1 to 10 microns. For example, the light-emitting diode may emit red light, blue light, green light, or the like.

Figure 2:
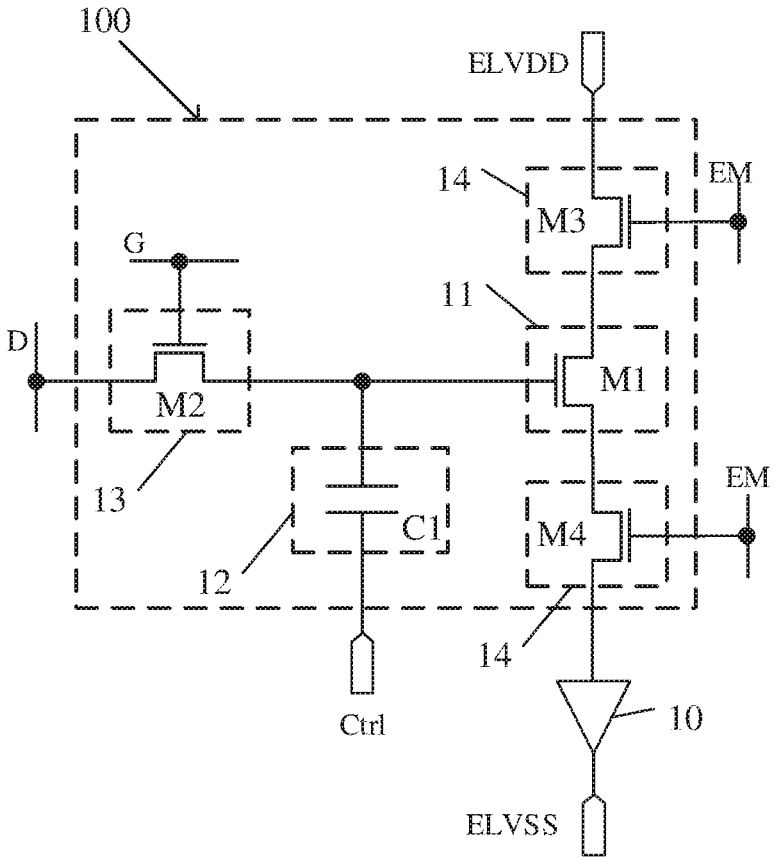
FIG. 2 is a structural schematic diagram of a pixel circuit provided by some embodiments of the present disclosure.

FIG. 2 is a structural schematic diagram of a pixel circuit provided by some embodiments of the present disclosure.

For example, as shown in FIG. 2, the second terminal of the storage circuit 12 is electrically connected to a control voltage terminal Ctrl, and the control voltage terminal Ctrl is configured to output the control signal $V_{cs}$ that changes with time. The first control voltage $V_{cv}$ is applied to the light-emitting driving circuit 11 via the first terminal of the storage circuit 12.

For example, the control signal $V_{cs}$ may be a triangular wave signal, a sawtooth wave signal, a sine wave signal, a stepped wave signal, or the like. As long as the control signal $V_{cs}$ can change with time in a light-emitting phase of one frame time, so that the first control voltage $V_{cv}$ can change with time, thereby changing the turn-on time of the light-emitting driving circuit, the present disclosure does not limit the specific type of the control signal $V_{cs}$. The control signal $V_{cs}$ may still change with time in a phase (e.g., in a data writing phase, etc.) other than the light-emitting phase in one frame time, or may not change with time, i.e., the control signal $V_{cs}$ does not change in a phase other than the light-emitting phase.

For example, the storage circuit 12 is configured to add the control signal $V_{cs}$ and the first data voltage $V_{data1}$ to obtain the first control voltage $V_{cv}$, that is, the first control voltage $V_{cv}$ may be expressed as $V_{cv}=V_{cs}+V_{data1}$.

For example, the pixel circuit 100 may be integrated on a base substrate, and the base substrate may be a glass substrate, i.e., the pixel circuit 100 is formed on the glass substrate. However, the present disclosure is not limited to this case, the base substrate may be a suitable substrate, such as a ceramic substrate, a quartz substrate, or the like.

For example, as shown in FIG. 2, the light-emitting driving circuit 11 includes a driving transistor M1. A first electrode of the driving transistor M1 is electrically connected to the first power terminal ELVDD, a second electrode of the driving transistor M1 is electrically connected to a first terminal of the light-emitting element 10, and a gate electrode of the driving transistor M1 is respectively electrically connected to the data writing circuit 13 and the storage circuit 12. A second terminal of the light-emitting element 10 is electrically connected to a second power terminal ELVSS.

For example, the first control voltage $V_{cv}$ may be applied to the gate electrode of the driving transistor M1 to control the driving transistor M1 to be turned on or off.

For example, in the embodiments of the present disclosure, "the light-emitting driving circuit 11 is turned on" may represent that the driving transistor M1 is turned on and in a linear amplification state. At this phase, a current flowing through the driving transistor M1 is proportional to a source-drain voltage of the driving transistor M1, and is independent of a voltage of the gate electrode of the driving transistor M1. In some embodiments of the present disclosure, by fixing a voltage difference between the first power terminal ELVDD and the second power terminal ELVSS, driving currents are substantially equal to each other in respective times, in which the light-emitting driving circuit 11 is turned on, and therefore, luminance in per unit time of light-emitting elements of sub-pixels using the pixel circuit are substantially equal to each other, so that gray scale of the sub-pixel is only related to a length of the time during which the light-emitting driving circuit 11 is turned on.

For example, one of the first power terminal ELVDD and the second power terminal ELVSS is a high voltage terminal and the other is a low voltage terminal. For example, in the embodiment as shown in FIG. 2, the first power terminal ELVDD is a voltage source to output a constant positive voltage; the second power terminal ELVSS may be a voltage source to output a constant negative voltage, or may be grounded or the like. Compared with a pixel circuit of an organic light-emitting diode panel, in the pixel circuit 100 provided by some embodiments of the present disclosure, the voltage difference between the first power terminal ELVDD and the second power terminal ELVSS is small, for example, a voltage output by the first power terminal ELVDD may be about 3V, a voltage output by the second power terminal ELVSS may be about 0V, and the voltage difference between the first power terminal ELVDD and the second power terminal ELVSS may be about 3V.

Figure 3A:
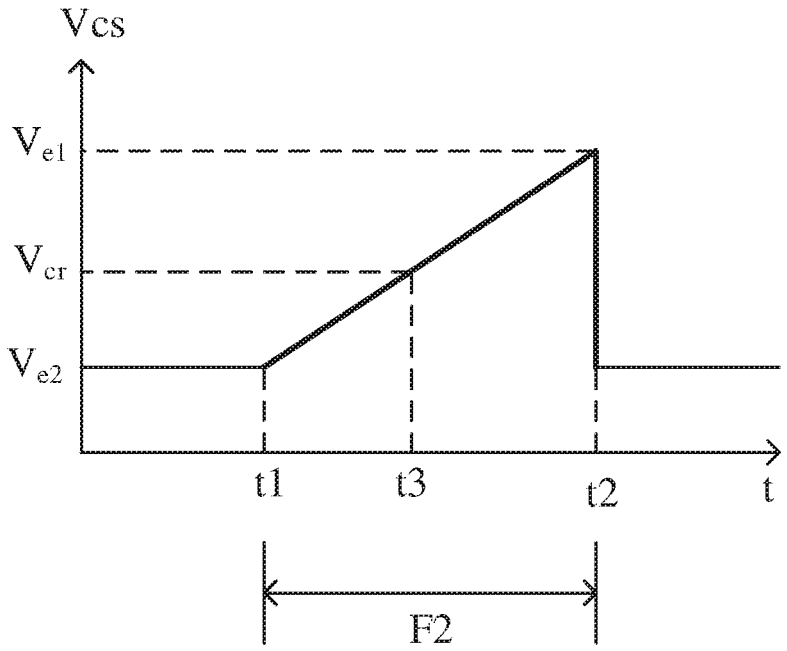
FIG. 3A is a schematic diagram of a control signal provided by some embodiments of the present disclosure.
Figure 3B:
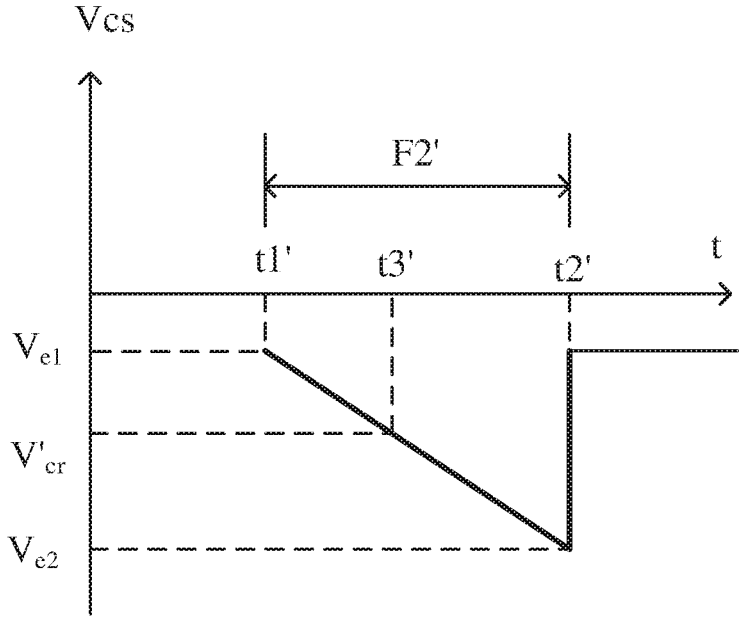
FIG. 3B is a schematic diagram of a control signal provided by other embodiments of the present disclosure.

FIG. 3A is a schematic diagram of a control signal provided by some embodiments of the present disclosure, and FIG. 3B is a schematic diagram of a control signal provided by other embodiments of the present disclosure.

For example, by taking a case that the control signal $V_{cs}$ is a triangular wave signal as an example, the control signal $V_{cs}$ includes a maximum value and a minimum value. As shown in FIG. 3A, a coordinate system is established with the control signal $V_{cs}$ and the time t as two coordinate axes, the control signal $V_{cs}$ is the ordinate, and the time t is the abscissa. In some examples, in a case where the driving transistor M1 is an N-type transistor, the maximum value and the minimum value of the control signal $V_{cs}$ satisfy the following relational expression:

$$V_{data1}-V_{e2}+V_{e1}<V_{dd}+V_{th} \quad (1)$$

where $V_{data1}$ represents the first data voltage, $V_{e1}$ represents the maximum value. $V_{e2}$ represents the minimum value, $V_{dd}$ represents a first power voltage output from the first power terminal ELVDD, and $V_{th}$ represents a threshold voltage of the driving transistor M1. "The maximum value $V_{e1}$ of the control signal $V_{cs}$" represents the maximum value of the control signal $V_{cs}$ in a light-emitting phase F2, and "the minimum value $V_{e2}$ of the control signal $V_{cs}$" represents the minimum value of the control signal $V_{cs}$ in the light-emitting phase F2. At this time, the control signal $V_{cs}$ gradually increases with time, that is, the control signal $V_{cs}$ has a minimum value $V_{e2}$ at a starting point of the light-emitting phase F2 (i.e., a time point t1), and the control signal $V_{cs}$ has a maximum value $V_{e1}$ at an end point of the light-emitting phase F2 (i.e., a time point t2).

Alternatively, as shown in FIG. 3B, a coordinate system is established with the control signal $V_{cs}$ and the time t as two coordinate axes, the control signal $V_{cs}$ is the ordinate, and the time t is the abscissa. In other examples, in a case where the driving transistor M1 is a P-type transistor, the maximum value and the minimum value of the control signal $V_{cs}$ satisfy the following relational expression:

$$V_{data1}-V_{e1}+V_{e2}<V_{dd}+V_{th} \quad (2)$$

where $V_{data1}$ represents the first data voltage, $V_{e1}$ represents the maximum value, $V_{e2}$ represents the minimum value, $V_{dd}$ represents the first power voltage output from the first power terminal ELVDD, and $V_{th}$ represents the threshold voltage of the driving transistor. At this time, the control signal $V_{cs}$ gradually decreases with time, that is, the control signal $V_{cs}$ has a maximum value $V_{e1}$ at a starting point of the light-emitting phase F2' (i.e., a time point t1'), and has a minimum value $V_{e2}$ at an end point of the light-emitting phase F2' (i.e., a time point t2').

It should be noted that in the examples as shown in FIGS. 3A and 3B, by taking a case that the control signal $V_{cs}$ is a triangular wave signal as an example, at this time, the control signal $V_{cs}$ has a linear relationship with time, that is, the control signal $V_{cs}$ increases linearly with time. However, the embodiments of the present disclosure is not limited to this case. The control signal $V_{cs}$ is a sine wave signal, at this time, the control signal $V_{cs}$ may also have a nonlinear relationship with time, that is, the control signal $V_{cs}$ increases nonlinearly with time. In a case where the control signal $V_{cs}$ is a sine wave signal, the sine wave signal also has a maximum value and a minimum value in the light-emitting phase F2, and the maximum value and the minimum value still satisfy the above relational expression (1) or the relational expression (2).

For example, as shown in FIG. 3A, by taking a case that the driving transistor M1 is an N-type transistor as an example, in the light-emitting phase F2, the control signal $V_{cs}$ has a minimum value $V_{e2}$ at the time point t1 (i.e., the starting point of the light-emitting phase F2), the control signal $V_{cs}$ has a maximum value $V_{e1}$ at the time point t2 (i.e., the end point of the light-emitting phase F2), the control signal $V_{cs}$ has a critical value $V_{cr}$ at a time point 3 (i.e., a critical time point), and at this time, the critical value Vcr satisfies the following relational expression:

$$V_{data1}-V_{e2}+V_{cr}=V_{dd}+V_{th}.$$

Thus, in the light-emitting phase F2, the driving transistor M1 is in a turn-off state in a time period Δt1 which is from the time point t1 to the time point t3; in a time period Δt2, which is from the time point t3 to the time point t2, the driving transistor M1 is turned on, so that the light-emitting element 10 can be driven to emit light. The turn-on time of the light-emitting driving circuit 11 is the time period Δt2 from the time point t3 to the time point t2. By adjusting parameters, such as a slope, the minimum value, and the maximum value of the triangular wave signal, a length of the time period Δt2 can be adjusted, thereby adjusting the length of the turn-on time of the light-emitting driving circuit 11.

For example, as shown in FIG. 3B, by taking a case that the driving transistor M1 is a P-type transistor as an example, in the light-emitting phase F2', the control signal $V_{cs}$ has the maximum value $V_{e1}$ at the time point t1' (i.e., the starting point of the light-emitting phase F2'), the control signal $V_{cs}$ has the minimum value $V_2$ at the time point t2' (i.e., the end point of the light-emitting phase F2'), the control signal $V_{cs}$ has a critical value $V'_{cr}$ at the time point t3' (i.e., a critical time point), and at this time, the critical value $V'_{cr}$ satisfies the following relational expression:

$$V_{data1}-V_{e1}+V_{cr}=V_{dd}+V_{th}.$$

Thus, in the light-emitting phase F2', the driving transistor M1 is in a turn-off state in a time period Δt1', which is from the time point t1' to the time point t3'. In a time period Δt2', which is from the time point t3' to the time point t2', the driving transistor M1 is turned on, so that the light-emitting element 10 can be driven to emit light. The turn-on time of the light-emitting driving circuit 11 is the time period Δt2' from the time point t3' to the time point t2'. By adjusting parameters, such as the slope, the minimum value, and the maximum value of the triangular wave signal, a length of the time period Δt2' can be adjusted, thereby adjusting the length of the turn-on time of the light-emitting driving circuit 11.

For example, as shown in FIG. 2, the storage circuit 12 includes a capacitor C1. In some examples, the first terminal of the storage circuit 12 includes a first electrode of the capacitor C1, the second terminal of the storage circuit 12 includes a second electrode of the capacitor C1, i.e., the first electrode of the capacitor C1 is respectively electrically connected to the data writing circuit 13 and the light-emitting driving circuit 11, and the second electrode of the capacitor C1 is electrically connected to the control voltage terminal Ctrl. It should be noted that the storage circuit 12 as shown in FIG. 2 is only schematic, and the specific structure of the storage circuit 12 is not limited by the present disclosure. For example, the storage circuit 12 may also include elements, such as resistors and the like. In this case, two electrodes of the capacitor C1 may not be the two terminals of the storage circuit 12.

Figure 4A:
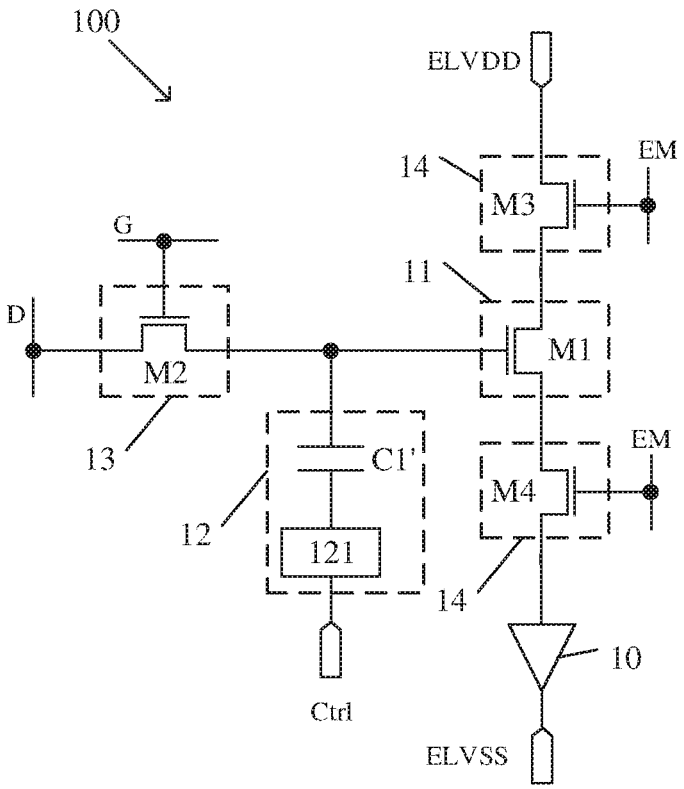
FIG. 4A is a structural schematic diagram of a pixel circuit provided by other embodiments of the present disclosure.
Figure 4B:
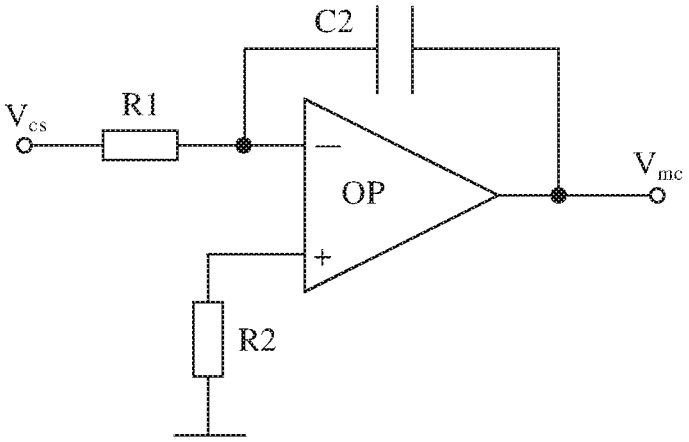
FIG. 4B is a structural schematic diagram of a signal conversion sub-circuit provided by some embodiments of the present disclosure.

FIG. 4A is a structural schematic diagram of a pixel circuit provided by other embodiments of the present disclosure, and FIG. 4B is a structural schematic diagram of a signal conversion sub-circuit provided by some embodiments of the present disclosure.

For example, the second terminal of the storage circuit 12 is electrically connected to the control voltage terminal Ctrl, and the control voltage terminal Ctrl is configured to output the control signal $V_{cs}$, the control signal $V_{cs}$ may be a square wave signal, that is, the control signal $V_{cs}$ does not change with time during the light-emitting phase, that is, the value of the control signal $V_{cs}$ is the same throughout the light-emitting phase.

For example, as shown in FIG. 4A, the storage circuit 12 may include a capacitor C1' and a signal conversion sub-circuit 121. The first terminal of the storage circuit 12 includes a first electrode of the capacitor C1', the second terminal of the storage circuit 12 includes a second terminal of the signal conversion sub-circuit 121, i.e., the first electrode of the capacitor C1' is respectively electrically connected to the data writing circuit 13 and the light-emitting driving circuit 11, the second terminal of the signal conversion sub-circuit 121 is electrically connected to the control voltage terminal Ctrl, a second electrode of the capacitor C1' is connected to a first terminal of the signal conversion sub-circuit 121.

For example, the signal conversion sub-circuit 121 is configured to convert the control signal $V_{cs}$ into an intermediate control signal that changes with time, and the intermediate control signal may be a triangular wave signal, a sawtooth wave signal, a sine wave signal, a stepped wave signal, or the like. The capacitor C1' is configured to generate the first control voltage $V_{cv}$, that changes with time, according to the intermediate control signal and the first data voltage $V_{data1}$.

For example, the control signal $V_{cs}$ is a square wave signal, the intermediate control signal is a triangular wave signal, and the signal conversion sub-circuit 121 may include an integration circuit. As shown in FIG. 4B, an exemplary integration circuit includes a capacitor C2, a first resistor R1, a second resistor R2, and an operation amplifier OP, and the integration circuit may convert the square wave signal into a triangular wave signal or a sawtooth wave signal, or the like. In some examples, a first terminal of the first resistor R1 is configured to receive the control signal $V_{cs}$ and a second terminal of the first resistor R1 is connected to an inverting input terminal − of the operation amplifier OP; a first terminal of the capacitor C2 is connected to the inverting input terminal − of the operation amplifier OP, and the second terminal of the capacitor C2 is connected to the output terminal of the operation amplifier OP; a first terminal of the second resistor R2 is connected to the non-inverting input terminal + of the operation amplifier OP, and a second terminal of the second resistor R2 is grounded. The output terminal of the operation amplifier OP is configured to output the intermediate control signal $V_{mc}$. By adjusting parameters of the capacitor C2, the first resistor R1, and the second resistor R2 in the integration circuit, a frequency, a maximum value, a minimum value, and other parameters of the intermediate control signal $V_{mc}$ can be adjusted. In addition, the intermediate control signal $V_{mc}$ also changes with the control signal $V_{cs}$, that is, if control signals $V_{cs}$ (e.g., period, amplitude, etc.) are different, intermediate control signals $V_{mc}$, which are generated, are also different.

It should be noted that the signal conversion sub-circuit 121 may be formed on the base substrate. However, embodiments of the present disclosure are not limited to this case. In some embodiments, the signal conversion sub-circuit 121 may also be formed on a drive chip to reduce an area occupied by the pixel circuit 100 on the base substrate and improve the resolution. For example, the drive chip is bonded to the base substrate through a flexible printed circuit board. At this time, the capacitor C1' in the storage circuit 12 can still be formed on the base substrate.

For example, as shown in FIGS. 2 and 4A, the data writing circuit 13 includes a data writing transistor M2. A first electrode of the data writing transistor M2 is electrically connected to a data line D to receive the first data voltage $V_{data1}$, a second electrode of the data writing transistor M2 is electrically connected to the storage circuit 12, and a gate electrode of the data writing transistor M2 is electrically connected to a scanning signal line G to receive the scanning signal $V_{scan}$.

For example, as shown in FIG. 2, the second electrode of the data writing transistor M2 is electrically connected to the first electrode of the capacitor C1; the data line D is configured to provide the first data voltage $V_{data1}$ to the data writing transistor M2; the scanning signal line G is configured to provide the scanning signal $V_{scan}$ to the data writing transistor M2. For example, in the data writing phase, the scanning signal line G may provide a scanning signal to the gate electrode of the data writing transistor M2 to turn on the data writing transistor M2. Thus, the data writing transistor M2 can transmit the first data voltage $V_{data1}$ to the first electrode of the capacitor C1, and the capacitor C1 can store the first data voltage $V_{data1}$.

For example, as shown in FIGS. 2 and 4A, the pixel circuit 100 further includes a light-emitting control circuit 14. The light-emitting control circuit 14 is configured to control the light-emitting driving circuit 11 to drive the light-emitting element 10 to emit light under control of a light-emitting control signal.

For example, the light-emitting control circuit 14 may include a first light-emitting control transistor M3 and a second light-emitting control transistor M4. As shown in FIGS. 2 and 4A, a first electrode of the first light-emitting control transistor M3 is electrically connected to the first power terminal ELVDD, a second electrode of the first light-emitting control transistor M3 is electrically connected to the first electrode of the driving transistor M1, and a gate electrode of the first light-emitting control transistor M3 is electrically connected to a light-emitting control line EM to receive the light-emitting control signal $V_{EM}$; a first electrode of the second light-emitting control transistor M4 is electrically connected to the second electrode of the driving transistor M1, a second electrode of the second light-emitting control transistor M4 is electrically connected to the first terminal of the light-emitting element 10, and a gate electrode of the second light-emitting control transistor M4 is electrically connected to the light-emitting control line EM to receive the light-emitting control signal $V_{EM}$.

For example, in the data writing phase, the second light-emitting control transistor M4 may turn off the connection between the driving transistor M1 and the light-emitting element 10 to ensure that the light-emitting element 10 does not emit light. In the light-emitting phase, the light-emitting control line EM may provide the light-emitting control signal $V_{EM}$ to the first light-emitting control transistor M3 and the second light-emitting control transistor M4 to turn on the first light-emitting control transistor M3 and the second light-emitting control transistor M4, thereby forming a conduction loop from the first power terminal ELVDD to the second power terminal ELVSS, and a light-emitting current may be transmitted to the light-emitting element 10 via the driving transistor M1, which is turned on, to drive the light-emitting element 10 to emit light. The first control voltage $V_{cv}$ can control the turn-on time of the driving transistor M2, thereby controlling the light-emitting time of the light-emitting element 10. The length of the light-emitting time can determine the display brightness of the light-emitting element 10, i.e., the level of the gray scale corresponding to the light-emitting element 10.

It should be noted that in the examples as shown in FIGS. 2 and 4A, the gate electrode of the first light-emitting control transistor M3 and the gate electrode of the second light-emitting control transistor M4 are connected to the same light-emitting control line EM to receive the same light-emitting control signal $V_{EM}$. However, the embodiments of the present disclosure are not limited to this case, in other embodiments, the gate electrode of the first light-emitting control transistor M3 and the gate electrode of the second light-emitting control transistor M4 may also be electrically connected to different light-emitting control lines, and the light-emitting control signals applied by the different light-emitting control lines are synchronized. The embodiment of the present disclosure does not limit the control methods of the first light-emitting control transistor M3 and the second light-emitting control transistor M4.

It is worth noting that the light-emitting driving circuit 11, the storage circuit 12, the data writing circuit 13, and the light-emitting control circuit 14 are not limited to the structures described in the above embodiments, and the specific structures thereof can be set according to actual application requirements, and the embodiments of the present disclosure are not specifically limited to this case. The pixel circuit 100 may further include a reset circuit, a compensation circuit, etc. For example, the compensation circuit may be implemented by voltage compensation, current compensation, or hybrid compensation, and the compensation circuit may compensate the threshold voltage of the driving transistor M1 and the voltage drop of the power terminal, etc. to improve the display quality and the display effect. The reset circuit can reset the gate electrode of the driving transistor M1 to prevent signals between different frames from interfering with each other.

Some embodiments of the present disclosure also provide a driving method of the pixel circuit, and the driving method can be applied to the pixel circuit described in any one of the above embodiments.

Figure 5:
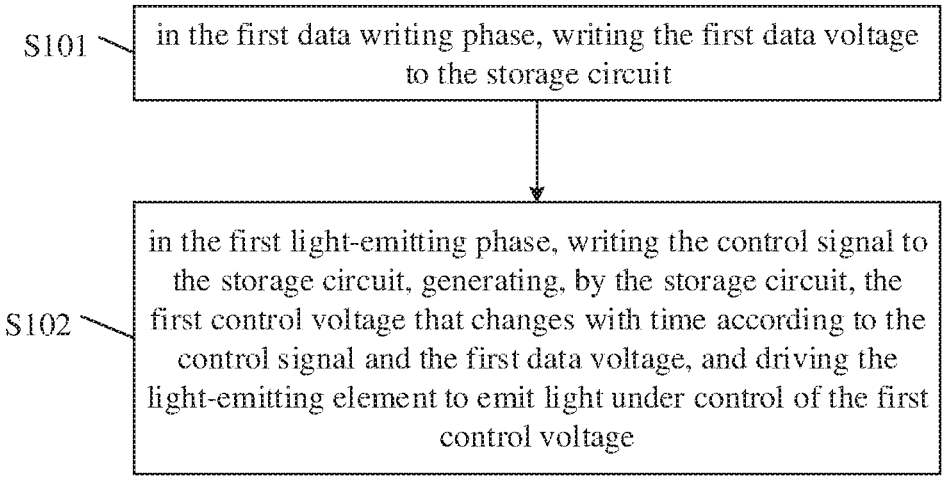
FIG. 5 is a schematic flow chart of a driving method of a pixel circuit provided by some embodiments of the present disclosure.

FIG. 5 is a schematic flow chart of a driving method of a pixel circuit provided by some embodiments of the present disclosure.

For example, one frame time includes a first data writing phase and a first light-emitting phase. As shown in FIG. 5, the driving method of the pixel circuit includes the following steps:

S101: in the first data writing phase, writing the first data voltage to the storage circuit;

S102: in the first light-emitting phase, writing the control signal to the storage circuit, generating, by the storage circuit, the first control voltage that changes with time according to the control signal and the first data voltage, and driving the light-emitting element to emit light under control of the first control voltage.

According to the driving method of the pixel circuit, gray scales are controlled, under a fixed voltage, by controlling the light-emitting time of the Micro LED, i.e., a display driving scheme for displaying more gray scales is achieved by matching the fixed voltage with the control voltage (e.g., the first control voltage) which changes with time, so that the problem of the color coordinates deviation of the Micro LED light-emitting elements under different currents is solved.

For example, the control signal may be a signal that changes with time, and the storage circuit may include a capacitor, i.e., the storage circuit is the storage circuit in the example as shown in FIG. 2, in this example, in step S102, the operation of generating the first control voltage that changes with time according to the control signal and the first data voltage includes: adding the control signal and the first data voltage to obtain the first control voltage.

For example, the control signal may be a signal that does not change with time, for example, the control signal is a square wave signal. At this time, the storage circuit includes a capacitor and a signal conversion sub-circuit, i.e., the storage circuit is the storage circuit in the example as shown in FIG. 4A. In this example, in step S102, the operation of generating the first control voltage that changes with time according to the control signal and the first data voltage includes: converting control signal into the intermediate control signal through the signal conversion sub-circuit, and the intermediate control signal being a signal that changes with time; and adding the intermediate control signal and the first data voltage to obtain the first control voltage.

For example, the light-emitting driving circuit includes a driving transistor, and in step S102, under control of the first control voltage, the operation of driving the light-emitting element to emit light includes that the first control voltage controls the driving transistor to be turned on so that light-emitting current flows into the light-emitting element via the driving transistor to drive the light-emitting element to emit light. For example, the first control voltage can control the turn-on time of the driving transistor to control the light-emitting time of the light-emitting element, and finally control the light-emitting brightness (i.e., gray scale) of the light-emitting element.

For example, in some embodiments, one frame time further includes a second data writing phase and a second light-emitting phase, and the driving method further includes:

S103: in the second data writing phase, writing a second data voltage to the storage circuit;

S104: in the second light-emitting phase, writing the control signal to the storage circuit, and generating, by the storage circuit, a second control voltage that changes with time according to the control signal and the second data voltage, and driving the light-emitting element to emit light under control of the second control voltage.

In the driving method, the light-emitting element is driven to emit light for a plurality of times in one frame time, and the gray scale of the display panel is finally controlled by superimposing the light-emitting time of the light-emitting element in a plurality of light-emitting processes, so that more gray scales can be displayed in one frame time.

For example, in some embodiments, the control signal is a signal that changes with time, and in the first light-emitting phase, the control signal includes a first maximum value and a first minimum value.

In some examples, in a case where the driving transistor is a P-type transistor, the first maximum value and the first minimum value satisfy the following relational expression:

$$V_{data1}-V_{e11}+V_{e12}<V_{dd}+V_{th},$$

where $V_{data1}$ represents the first data voltage, $V_{e11}$ represents the first maximum value, $V_{e12}$ represents the first minimum value, $V_{dd}$ represents the first power voltage output from the first power terminal, and $V_{th}$ represents the threshold voltage of the driving transistor.

For example, the control signal also has a first critical value, and the first critical value $V_{cr1}$ satisfies the following relational expression:

$$V_{data1}-V_{e11}+V_{cr1}<V_{dd}+V_{th}.$$

In other examples, in a case where the driving transistor is an N-type transistor, the first maximum value and the first minimum value satisfy the following relational expression:

$$V_{data1}-V_{e12}+V_{e11}<V_{dd}+V_{th}.$$

where $V_{data1}$ represents the first data voltage, $V_{e11}$ represents the first maximum value, $V_{e12}$ represents the first minimum value, $V_{dd}$ represents the first power voltage output from the first power terminal, and $V_{th}$ represents the threshold voltage of the driving transistor.

For example, the control signal also has a first critical value, and the first critical value Vcr1 satisfies the following relational expression:

$$V_{data1}-V_{e12}+V_{cr1}<V_{dd}+V_{th}.$$

For example, in some embodiments, the control signal is a signal that changes with time, and in the second light-emitting phase, the control signal includes a second maximum value and a second minimum value.

In some examples, in a case where the driving transistor is a P-type transistor, the second maximum value and the second minimum value satisfy the following relational expression:

$$V_{data1}-V_{e21}+V_{e22}<V_{dd}+V_{th},$$

where $V_{data2}$ represents the second data voltage, $V_{e21}$ represents the second maximum value, $V_{e22}$ represents the second minimum value, $V_{dd}$ represents the first power voltage output from the first power terminal, and $V_{th}$ represents the threshold voltage of the driving transistor.

For example, the control signal also has a second critical value, and the second critical value $V_{cr2}$ satisfies the following relational expression:

$$V_{data2}-V_{e21}+V_{cr2}<V_{dd}+V_{th}.$$

In other examples, in a case where the driving transistor is an N-type transistor, the second maximum value and the second minimum value satisfy the following relational expression:

$$V_{data2}-V_{e22}+V_{e21}<V_{dd}+V_{th}.$$

where $V_{data2}$ represents the second data voltage, $V_{e21}$ represents the second maximum value, $V_{e22}$ represents the second minimum value, $V_{dd}$ represents the first power voltage output from the first power terminal, and $V_{th}$ represents the threshold voltage of the driving transistor.

For example, the control signal also has a second critical value, and the second critical value $V_{cr2}$ satisfies the following relational expression:

$$V_{data1}-V_{e22}+V_{cr2}<V_{dd}+V_{th}.$$

In other examples, it should be explained that the related description about the first maximum value and the second maximum value can refer to the related description about the maximum value in the embodiment of the pixel circuit, the related description about the first minimum value and the second minimum value can refer to the related description about the minimum value in the embodiment of the pixel circuit, and the related description about the first critical value and the second critical value can refer to the related description about the critical value in the embodiment of the pixel circuit, and the repetition is not repeated herein again.

For example, in the first light-emitting phase, the light-emitting time of the light-emitting element is a first light-emitting time; in the second light-emitting phase, the light-emitting time of the light-emitting element is a second light-emitting time. The light-emitting time of the light-emitting element in the first light-emitting phase is different from the light-emitting time of the light-emitting element in the second light-emitting phase, that is, the first light-emitting time and the second light-emitting time are different.

For example, in some embodiments, the first data voltage may be different from the second data voltage. The control signal in the first light-emitting phase may be the same as the control signal in the second light-emitting phase, and in this case, the first control voltage generated in the first light-emitting phase is different from the second control voltage generated in the second light-emitting phase, and therefore, the first light-emitting time may be different from the second light-emitting time.

For another example, in other embodiments, the first data voltage may be the same as the second data voltage. The control signal in the first light-emitting phase may be different from the control signal in the second light-emitting phase, and in this case, the first control voltage generated in the first light-emitting phase is different from the second control voltage generated in the second light-emitting phase, and therefore, the first light-emitting time may be different from the second light-emitting time.

Alternatively, in still other embodiments, the first data voltage may be different from the second data voltage, and the control signal in the first light-emitting phase may also be different from the control signal in the second light-emitting phase. In this case, the first control voltage generated in the first light-emitting phase is different from the second control voltage generated in the second light-emitting phase, and therefore, the first light-emitting time may be different from the second light-emitting time.

For another example, in still other embodiments, the first data voltage may be the same as the second data voltage. The control signal in the first light-emitting phase may also be the same as the control signal in the second light-emitting phase, in this case, the first control voltage generated in the first light-emitting phase is the same as the second control voltage generated in the second light-emitting phase, whereby the first light-emitting time may be the same as the second light-emitting time.

It should be noted that the first data voltage, the second data voltage, the control signal in the first light-emitting phase, and the control signal in the second light-emitting phase can be designed according to actual application, and the embodiments of the present disclosure are not limited to this case. The operation process of the second light-emitting phase is similar to the operation process of the first light-emitting phase. For the relevant description of the operation process of the second light-emitting phase, reference can be made to the above description of the first light-emitting phase, and the repetition will not be repeated again.

For example, the timing chart of the pixel circuit can be set according to actual requirements, and the embodiments of the present disclosure do not specifically limit the timing chart of the pixel circuit.

Figure 6:
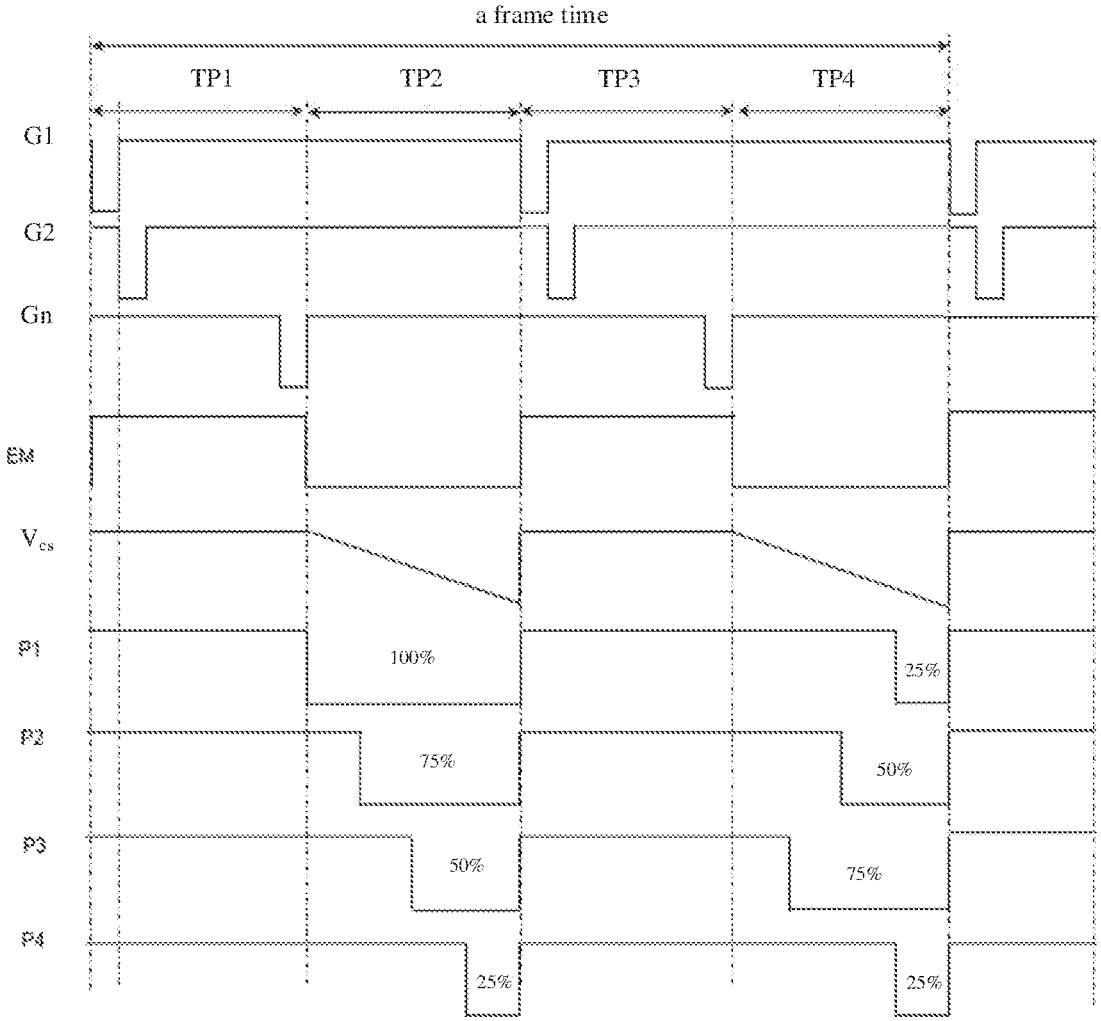
FIG. 6 is an exemplary timing chart of a driving method of the pixel circuit as shown in FIG. 2.

In some examples, FIG. 6 is an exemplary timing diagram of a driving method of the pixel circuit as shown in FIG. 2. The operation flow of a driving method of the pixel circuit provided by the embodiment of the present disclosure will be described in detail below with reference to FIGS. 2 and 6.

For example, as shown in FIGS. 2 and 6, in a first data writing phase TP1, the light-emitting control signal provided by the light-emitting control line EM is a high level signal, so that the first light-emitting control transistor M3 and the second light-emitting control transistor M4 are turned off, so that no current flows to the light-emitting element 10, and the light-emitting element 10 does not emit light. Scanning signals are sequentially supplied to a plurality of rows of pixel circuits through a plurality of scanning signal lines G1 to Gn, and the scanning signals provided by the scanning signal lines are at effective portions (i.e., the portions that make switching circuits (e.g., transistors) connected thereto be turned on), for example, the scanning signals are low-level signals, so that the data writing transistor M2 is turned on, and a plurality of first data voltages can be sequentially stored in storage circuits of respective pixel circuits. It should be noted that the plurality of first data voltages may be different from each other or may be at least partially the same.

For example, in the first data writing phase TP1, the control signal Vcs does not change with time.

For example, as shown in FIGS. 2 and 6, in a first light-emitting phase TP2, the light-emitting control signal provided by the light-emitting control line EM is a low-level signal, so that the first light-emitting control transistor M3 and the second light-emitting control transistor M4 are turned on, while the scanning signals sequentially provided by the plurality of scanning signal lines G1 to Gn to the plurality of rows of pixel circuits are at ineffective portions, e.g., the scanning signals are high-level signals, so that the data writing transistor M2 is turned off, which also causes the first terminal of the capacitor C1 to be at a floating state substantially. At this time, the control signal $V_{cs}$ is a triangular wave signal as shown in FIG. 6, if in the first data writing phase TP1, the first data voltage satisfies the following relational expression:

$$V_{data1} \leq V_{dd} + V_{th}$$

where $V_{data1}$ represents the first data voltage, $V_{dd}$ represents the first power voltage output from the first power terminal ELVDD, and Vth represents the threshold voltage of the driving transistor M1. In this case, the driving transistor M1 is turned on during the entire first light-emitting phase TP2, so that a P1 waveform of FIG. 6 shows the light-emitting time of the light-emitting element 10, that is, the light-emitting time of the light-emitting element 10 is 100% of the time of the first light-emitting phase TP2, that is, the light-emitting element 10 emits light throughout the first light-emitting phase TP2.

However, in a case where the first data voltage satisfies the following relational expression in the first data writing phase TP1: $V_{data1} > V_{dd} + V_{th}$, the driving transistor M1 is in a turn-off state during an initial time period of the first light-emitting phase TP2, no current flows to the light-emitting element 10, and the light-emitting element 10 does not emit light. Because the control signal $V_{cs}$ changes with time and because the first terminal of the capacitor C1 is substantially floated, the voltage value of the first terminal of the capacitor C1 also changes with the control signal $V_{cs}$ according to the charge conservation law of the capacitor. In a case where the value of the control signal $V_{cs}$ exceeds the critical value, the driving transistor M1 is turned on, and thus the light-emitting element 10 starts to emit light. Finally, the light-emitting time of the light-emitting element 10 exhibits a P2 waveform, a P3 waveform, or a P4 waveform as shown in FIG. 6, that is, the light-emitting time of the light-emitting element 10 may be 75%, 50%, or 25% of the time of the first light-emitting phase TP2, respectively.

For example, the length of the light-emitting time of the light-emitting element 10 depends on the relationship between the voltage value at the first terminal of the capacitor C1 and the threshold voltage Vth of the driving transistor M1. The light-emitting time of the light-emitting element 10 is not limited to 75%, 50%, 25% of the time of the first light-emitting phase TP2, but may also be 70%, 20%, or 15% of the time of the first light-emitting phase TP2.

For example, as shown in FIGS. 2 and 6, in a second data writing phase TP3, the operation of the first data writing phase TP1 is repeatedly performed in this phase, that is, in the second data writing phase TP3, the light-emitting control signal provided by the light-emitting control line EM is a high level signal, so that the first light-emitting control transistor M3 and the second light-emitting control transistor M4 are turned off, so that no current flows to the light-emitting element 10, and the light-emitting element 10 does not emit light. Scanning signals are sequentially supplied to the plurality of rows of pixel circuits through the plurality of scanning signal lines G1 to Gn, the scanning signals provided by the scanning signal lines are in effective portions and are low-level signals, so that the data writing transistor M2 is turned on, and a plurality of second data voltages may be sequentially stored in storage circuits of the respective pixel circuits. It should be noted that the plurality of second data voltages may be different from each other or at least a portion of the plurality of second data voltages may be the same. The first data voltage and the second data voltage may be different, but the present disclosure is not limited thereto, and the first data voltage may also be the same as the second data voltage.

For example, in the second data writing phase TP3, the control signal Vcs also does not change with time.

For example, as shown in FIGS. 2 and 6, in a second light-emitting phase TP4, the operation of the first light-emitting phase TP2 is repeatedly performed in this phase, that is, in the second light-emitting phase TP4, the light-emitting control signal provided by the light-emitting control line EM is a low-level signal, so that the first light-emitting control transistor M3 and the second light-emitting control transistor M4 are turned on, while the scanning signals sequentially provided by the plurality of scanning signal lines G1 to Gn to the plurality of rows of pixel circuits are at ineffective portions and are high-level signals, so that the data writing transistor M2 is turned off, which also causes the first terminal of the capacitor C1 to be substantially floated. At this time, the control signal $V_{cs}$ is a triangular wave signal as shown in FIG. 6, if in the second data writing phase TP3, the second data voltage satisfies the following relational expression:

$$V_{data2} \leq V_{dd} + V_{th}$$

where $V_{data2}$, represents the second data voltage. $V_{dd}$ represents the first power voltage output from the first power terminal ELVDD, and $V_{th}$ represents the threshold voltage of the driving transistor M1, and is negative. In this case, the driving transistor M1 is turned on throughout the second light-emitting phase TP4, so that the light-emitting time of the light-emitting element 10 is 100% of the time of the second light-emitting phase TP4, that is, the light-emitting element 10 emits light throughout the second light-emitting phase TP4.

In the second data writing phase TP3, if the second data voltage satisfies the following relational expression: $V_{data2} > V_{dd} + V_{th}$, during an initial time period of the second light-emitting phase TP4, the driving transistor M1 is in a turn-off state, no current flows to the light-emitting element 10, and the light-emitting element 10 does not emit light. Because the control signal $V_{cs}$ changes with time, according to the charge conservation law of the capacitor, the voltage value at the first terminal of the capacitor C1 also changes with the control signal $V_{cs}$. In a case where the value of the control signal $V_{cs}$ exceeds the critical value, the driving transistor M1 is turned on, and thus the light-emitting element 10 starts to emit light. Finally, the light-emitting time of the light-emitting element 10 exhibits a P1 waveform, a P2 waveform, a P3 waveform, or a P4 waveform as shown in FIG. 6, i.e., the light-emitting time of the light-emitting element 10 may be 25%, 75%, 50%, or 25% of the time of the second light-emitting phase TP4, respectively.

For example, in one frame time, the light-emitting time of a light-emitting element is the superposition of the light-emitting time in the first light-emitting phase TP2 and the light-emitting time in the second light-emitting phase TP4. In a case where the P1 waveform in FIG. 6 shows the light-emitting time of the light-emitting element in one frame time, the light-emitting time of the light-emitting element can be expressed as:

$$t_{EL} = 100\% * t_{TP2} + 25\% * t_{TP4}$$

where $t_{EL}$ represents the light-emitting time of the light-emitting element in one frame time, $t_{TP2}$ represents the time of the first light-emitting phase TP2 in one frame time, and $t_{TP4}$ represents the time of the second light-emitting phase TP4 in one frame time.

In a case where the P2 waveform in FIG. 6 shows the light-emitting time of the light-emitting element in one frame time, the light-emitting time of the light-emitting element can be expressed as:

$$t_{EL}=70\%*t_{P2}+50\%*t_{TP4}$$

where $t_{EL}$ represents the light-emitting time of the light-emitting element in one frame time, $t_{TP2}$ represents the time of the first light-emitting phase TP2 in one frame time, and $t_{TP4}$ represents the time of the second light-emitting phase TP4 in one frame time.

To sum up, display pictures on the display panel can achieve more gray scales through superimposing two different light-emitting times.

It should be noted that the embodiment of the present disclosure is not limited to dividing one frame time into two data writing phases and two light-emitting phases. In some examples, one frame time can also be divided into one data writing phase and one light-emitting phase, three data writing phases and three light-emitting phases, four data writing phases and four light-emitting phases, etc.

Figure 7:
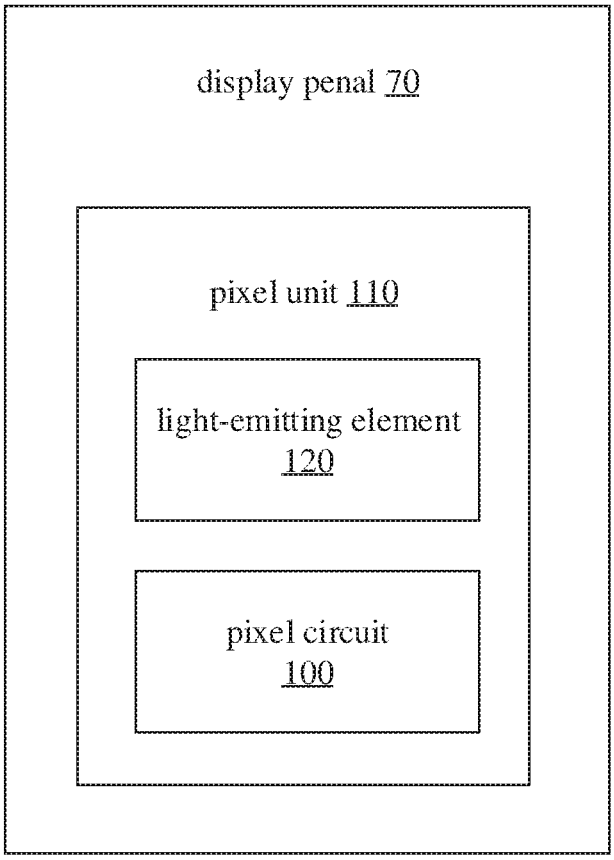
FIG. 7 is a schematic block diagram of a display panel provided by some embodiments of the present disclosure.

Some embodiments of the present disclosure also provide a display panel. FIG. 7 is a schematic block diagram of a display panel provided by some embodiments of the present disclosure. As shown in FIG. 7, the display panel 70 includes a plurality of pixel units 110, and the plurality of pixel units 110 may be arranged in an array. Each pixel unit 110 may include a light-emitting element 120 and the pixel circuit 100 described in any one of the above embodiments. The light-emitting element 120 is the light-emitting element 10 in the above-mentioned embodiments of the pixel circuit 100, and the repetition will not be described again.

The pixel circuit in the display panel can control gray scales, under a fixed voltage, by controlling the light-emitting time of the Micro LED, i.e. a display driving scheme for displaying more gray scales is achieved by matching the fixed voltage with the control voltage which changes with time, so that the problem of color coordinate deviation of the Micro LED light-emitting elements under different currents is solved; and the pixel circuit in the display panel can control the light-emitting time of the Micro LED without additional elements, and has a simple structure and low cost.

For example, in some embodiments, control signals applied to pixel circuits of all pixel units on the display panel 70 are the same; and in other embodiments, the control signals applied to all pixel circuits 100 of pixel units in the same row are the same, while the control signals applied to different rows of pixel units are different.

For example, a plurality of control signals in different frames are the same; alternatively, the plurality of control signals in different frames may be at least partially different.

For example, the display panel 70 further includes a base substrate, the base substrate may be a glass substrate, the pixel circuit 100 and the light-emitting element 120 are both formed on the base substrate, or are at least partially prepared on other intermediate substrates, and then transferred and mounted on the base substrate by transfer printing method or the like.

For example, the display panel 70 may be a rectangular panel, a circular panel, an oval panel, a polygonal panel, or the like. In addition, the display panel 70 may be not only a planar panel, but also a curved panel or even a spherical panel.

For example, the display panel 70 may also have a touch function, that is, the display panel 70 may be a touch display panel.

Figure 8:
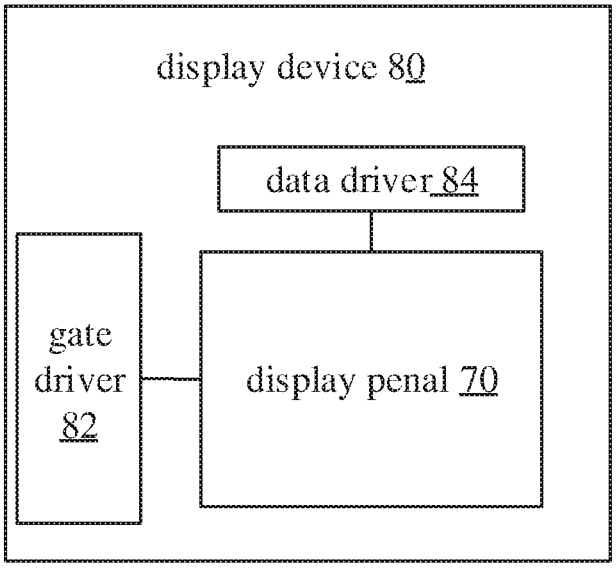
FIG. 8 is a schematic block diagram of a display device provided by some embodiments of the present disclosure.

The embodiment of the present disclosure also provides a display device. FIG. 8 is a schematic block diagram of a display device provided by some embodiments of the present disclosure. As shown in FIG. 8, the display device 80 may include the display panel 70 described in any one of the above embodiments, and the display panel 70 is used for displaying images.

For example, the display device 80 may further include a gate driver 82. The gate driver 320 is configured to be electrically connected to the data writing circuit through a scanning signal line for providing a scanning signal to the data writing circuit.

For example, the display device 80 may also include a data driver 84. The data driver 84 is configured to be electrically connected to the data writing circuit through a data line for providing data voltages, for example, a first data voltage and a second data voltage, to the display panel 70.

For example, the display device 80 may be any product or component having a display function, such as a mobile phone, a tablet computer, a television, a display, a notebook computer, a digital photo frame, a navigator, etc.

It should be noted that other components of the display device 80 (e.g., control device, image data encoding/decoding device, clock circuit, etc.) should be included by the display device and be understood by those of ordinary skill in the art, and are not described in detail herein again, nor should they be taken as limitations to the present disclosure.

For the present disclosure, the following points need to be explained:

(1) The drawings of the embodiments of the present disclosure only refer to the structures related to the embodiments of the present disclosure, and other structures may refer to the general design.

(2) For the sake of clarity, in the drawings used to describe embodiments of the present disclosure, the thicknesses and sizes of the layers or structures are exaggerated. It will be understood that in a case where an element, such as a layer, a film, a region, or a substrate, is referred to as being "on" or "under" another element, the element may be "directly" "on" or "under" the another element, or there may be an intermediate element between the element and the another element.

(3) In case of no conflict, the embodiments of the present disclosure and the features in the embodiments can be combined with each other to obtain new embodiments.

What have been described above merely are exemplary embodiments of the present disclosure, and not intended to define the scope of the present disclosure, and the scope of the present disclosure is determined by the appended claims.

What is claimed is:

1. A pixel circuit, comprising a light-emitting driving circuit, a storage circuit, a data writing circuit, and a light-emitting control circuit, wherein a first terminal of the storage circuit is respectively electrically connected to the data writing circuit and the light-emitting driving circuit, a second terminal of the storage circuit is configured to receive a control signal, and the storage circuit is configured to receive and store a first data voltage transmitted by the data writing circuit, to generate a first control voltage, that changes with time, according to the control signal and the first data voltage, and to cause the first control voltage to be applied to the light-emitting driving circuit to control a turn-on time of the light-emitting driving circuit; and the light-emitting driving circuit is configured to drive a light-emitting element to emit light under control of the first control voltage, the light-emitting driving circuit comprises a driving transistor, a gate electrode of the driving transistor is respectively electrically connected to the data writing circuit and the storage circuit, wherein the second terminal of the storage circuit is electrically connected to a control voltage terminal, and the control voltage terminal is configured to output the control signal, and the control signal is a square wave signal and does not change with time during the light-emitting element driven to emit light under control of the first control voltage, the light-emitting control circuit is configured to control the light-emitting driving circuit to drive the light-emitting element to emit light under control of a light-emitting control signal in a light-emitting phase, and wherein the light-emitting control circuit is configured to turn off a connection between the light-emitting driving circuit and the light-emitting element during the first data voltage being written to the storage circuit; and turn on the connection between the light-emitting driving circuit and the light-emitting element during the control signal being written to the storage circuit, wherein the storage circuit comprises a capacitor and a signal conversion sub-circuit, the first terminal of the storage circuit comprises a first electrode of the capacitor, the second terminal of the storage circuit comprises a second terminal of the signal conversion sub-circuit, a second electrode of the capacitor is connected to a first terminal of the signal conversion sub-circuit, the signal conversion sub-circuit is configured to convert the control signal into an intermediate control signal that changes with time, and the capacitor is configured to generate the first control voltage according to the intermediate control signal and the first data voltage, wherein the intermediate control is a triangular wave signal, and a length of the turn-on time of the light-emitting driving circuit is adjusted by adjusting a slope of the triangular wave signal;

wherein the light-emitting control circuit comprises a first light-emitting control transistor and a second light-emitting control transistor, a first electrode of the first light-emitting control transistor is electrically connected to a first power terminal, a second electrode of the first light-emitting control transistor is electrically connected to a first electrode of the driving transistor, and a gate electrode of the first light-emitting control transistor is electrically connected to a light-emitting control line to receive the light-emitting control signal; and a first electrode of the second light-emitting control transistor is electrically connected to the second electrode of the driving transistor, a second electrode of the second light-emitting control transistor is electrically connected to the first terminal of the light-emitting element, and a gate electrode of the second light-emitting control transistor is electrically connected to the light-emitting control line to receive the light-emitting control signal;

the light-emitting control signal is used to control the first light-emitting control transistor and the second light-emitting control transistor to turn on in the light-emitting phase;

wherein the light-emitting element is a light-emitting diode, and a size of the light-emitting diode is less than 100 microns;

the light-emitting phase comprises a first light-emitting phase, a light-emitting time of the light-emitting element in the first light-emitting phase is determined by the first control voltage and the light-emitting control signal;

the light-emitting driving circuit, the capacitor in the storage circuit, and the data writing circuit are formed on a base substrate, the signal conversion sub-circuit is formed on a drive chip, and the drive chip is bonded to the base substrate through a flexible printed circuit board.

2. The pixel circuit according to claim 1, wherein the data writing circuit comprises a data writing transistor, a first electrode of the data writing transistor is electrically connected to a data line, a second electrode of the data writing transistor is electrically connected to the storage circuit, and a gate electrode of the data writing transistor is electrically connected to a scanning signal line to receive a scanning signal.

3. The pixel circuit according to claim 1, wherein the data writing circuit comprises a data writing transistor, the light-emitting control circuit comprises a first light-emitting control transistor and a second light-emitting control transistor, a first electrode of the data writing transistor is electrically connected to a data line, a second electrode of the data writing transistor is electrically connected to a first electrode of the capacitor, and a gate electrode of the data writing transistor is electrically connected to a scanning signal line to receive a scanning signal;

a first electrode of the driving transistor is electrically connected to the first power terminal, a second electrode of the driving transistor is electrically connected to a first terminal of the light-emitting element, and the gate electrode of the driving transistor is respectively electrically connected to the second electrode of the data writing transistor and the first electrode of the capacitor;

and a second terminal of the light-emitting element is electrically connected to a second power terminal.

4. A driving method applied to a pixel circuit, wherein the pixel circuit comprises a light-emitting driving circuit, a storage circuit, a data writing circuit, and a light-emitting control circuit, a first terminal of the storage circuit is respectively electrically connected to the data writing circuit and the light-emitting driving circuit, a second terminal of the storage circuit is configured to receive a control signal, and the storage circuit is configured to receive and store a first data voltage transmitted by the data writing circuit, to generate a first control voltage, that changes with time, according to the control signal and the first data voltage, and to cause the first control voltage to be applied to the light-emitting driving circuit to control a turn-on time of the light-emitting driving circuit; and the light-emitting driving circuit is configured to drive a light-emitting element to emit light under control of the first control voltage, the light-emitting driving circuit comprises a driving transistor, a gate electrode of the driving transistor is respectively electrically connected to the data writing circuit and the storage circuit, wherein the second terminal of the storage circuit is electrically connected to a control voltage terminal, and the control voltage terminal is configured to output the control signal, and the control signal is a square wave signal and does not change with time during the light-emitting element driven to emit light under control of the first control voltage, wherein the storage circuit comprises a capacitor and a signal conversion sub-circuit, the first terminal of the storage circuit comprises a first electrode of the capacitor, the second terminal of the storage circuit comprises a second terminal of the signal conversion sub-circuit, a second electrode of the capacitor is connected to a first terminal of the signal conversion sub-circuit, the signal conversion sub-circuit is configured to convert the control signal into an intermediate control signal that changes with time, and the capacitor is configured to generate the first control voltage according to the intermediate control signal and the first data voltage, wherein the intermediate control is a triangular wave signal, and a length of the turn-on time of the light-emitting driving circuit is adjusted by adjusting a slope of the triangular wave signal, the light-emitting control circuit is configured to control the light-emitting driving circuit to drive the light-emitting element to emit light under control of a light-emitting control signal in a light-emitting phase, wherein the light-emitting control circuit comprises a first light-emitting control transistor and a second light-emitting control transistor, a first electrode of the first light-emitting control transistor is electrically connected to a first power terminal, a second electrode of the first light-emitting control transistor is electrically connected to a first electrode of the driving transistor, and a gate electrode of the first light-emitting control transistor is electrically connected to a light-emitting control line to receive the light-emitting control signal; and a first electrode of the second light-emitting control transistor is electrically connected to the second electrode of the driving transistor, a second electrode of the second light-emitting control transistor is electrically connected to the first terminal of the light-emitting element, and a gate electrode of the second light-emitting control transistor is electrically connected to the light-emitting control line to receive the light-emitting control signal;

the light-emitting control signal is used to control the first light-emitting control transistor and the second light-emitting control transistor to turn on in the light-emitting phase;

wherein the light-emitting element is a light-emitting diode, and a size of the light-emitting diode is less than 100 microns;

the light-emitting phase comprises a first light-emitting phase, a light-emitting time of the light-emitting element in the first light-emitting phase is determined by the first control voltage and the light-emitting control signal;

the light-emitting driving circuit, the capacitor in the storage circuit, and the data writing circuit are formed on a base substrate, the signal conversion sub-circuit is formed on a drive chip, and the drive chip is bonded to the base substrate through a flexible printed circuit board, one frame time comprises a first data writing phase and the light-emitting phase, and the driving method comprises:

in the first data writing phase, writing the first data voltage to the storage circuit; and in the first light-emitting phase, writing the control signal to the storage circuit, generating, by the storage circuit, the first control voltage that changes with time according to the control signal and the first data voltage, and driving the light-emitting element to emit light under control of the first control voltage, wherein the light-emitting control circuit is configured to turn off a connection between the light-emitting driving circuit and the light-emitting element during the first data writing phase, and turn on the connection between the light-emitting driving circuit and the light-emitting element during the first light-emitting phase.

5. The driving method according to claim 4, wherein the one frame time further comprises a second data writing phase, the light-emitting phase further comprises a second light-emitting phase, and the driving method further comprises:

in the second data writing phase, writing a second data voltage to the storage circuit; and in the second light-emitting phase, writing the control signal to the storage circuit, and generating, by the storage circuit, a second control voltage that changes with time according to the control signal and the second data voltage, and driving the light-emitting element to emit light under control of the second control voltage.

6. The driving method according to claim 5, wherein a first electrode of the driving transistor is electrically connected to the first power terminal, a second electrode of the driving transistor is electrically connected to a first terminal of the light-emitting element, the intermediate control signal comprises a maximum value and a minimum value, the driving transistor is a P-type transistor, and the maximum value and the minimum value satisfy a following relational expression:

$$V_{data1}-V_{e1}+V_{e2}<V_{dd}+V_{th}$$

where Vdata1 represents the first data voltage, Ve1 represents the maximum value, Ve2 represents the minimum value, Vdd represents a first power voltage output from the first power terminal, and Vth represents a threshold voltage of the driving transistor.

7. The driving method according to claim 5, wherein the first data voltage is different from the second data voltage.

8. The driving method according to claim 7, wherein a light-emitting time of the light-emitting element in the first light-emitting phase is different from a light-emitting time of the light-emitting element in the second light-emitting phase.

9. The driving method according to claim 4, wherein a first electrode of the driving transistor is electrically connected to the first power terminal, a second electrode of the driving transistor is electrically connected to a first terminal of the light-emitting element, the intermediate control signal comprises a maximum value and a minimum value, the driving transistor is a P-type transistor, and the maximum value and the minimum value satisfy a following relational expression:

$$V_{data1}-V_{e1}+V_{e2}<V_{dd}+V_{th}$$

where Vdata1 represents the first data voltage, Ve1 represents the maximum value, Ve2 represents the minimum value, Vdd represents a first power voltage output from the first power terminal, and Vth represents a threshold voltage of the driving transistor.

10. The driving method according to claim 4, wherein a first electrode of the driving transistor is electrically connected to the first power terminal, a second electrode of the driving transistor is electrically connected to a first terminal of the light-emitting element, the intermediate control signal comprises a maximum value and a minimum value, the driving transistor is an N-type transistor, and the maximum value and the minimum value satisfy a following relational expression:

$$V_{data1}-V_{e2}+V_{e1}<V_{dd}+V_{th}$$

where Vdata1 represents the first data voltage, Ve1 represents the maximum value, Ve2 represents the minimum value, Vdd represents a first power voltage output from the first power terminal, and Vth represents a threshold voltage of the driving transistor.

11. A display device, comprising a pixel circuit, wherein the pixel circuit comprises a light-emitting driving circuit, a storage circuit, a data writing circuit, and a light-emitting control circuit, a first terminal of the storage circuit is respectively electrically connected to the data writing circuit and the light-emitting driving circuit, a second terminal of the storage circuit is configured to receive a control signal, and the storage circuit is configured to receive and store a first data voltage transmitted by the data writing circuit, to generate a first control voltage, that changes with time, according to the control signal and the first data voltage, and to cause the first control voltage to be applied to the light-emitting driving circuit to control a turn-on time of the light-emitting driving circuit; and the light-emitting driving circuit is configured to drive a light-emitting element to emit light under control of the first control voltage, the light-emitting driving circuit comprises a driving transistor, a gate electrode of the driving transistor is respectively electrically connected to the data writing circuit and the storage circuit, wherein the second terminal of the storage circuit is electrically connected to a control voltage terminal, and the control voltage terminal is configured to output the control signal, and the control signal is a square wave signal and does not change with time during the light-emitting element driven to emit light under control of the first control voltage, the light-emitting control circuit is configured to control the light-emitting driving circuit to drive the light-emitting element to emit light under control of a light-emitting control signal in a light-emitting phase, and wherein the light-emitting control circuit is configured to turn off a connection between the light-emitting driving circuit and the light-emitting element during the first data voltage being written to the storage circuit; and turn on the connection between the light-emitting driving circuit and the light-emitting element during the control signal being written to the storage circuit, wherein the storage circuit comprises a capacitor and a signal conversion sub-circuit, the first terminal of the storage circuit comprises a first electrode of the capacitor, the second terminal of the storage circuit comprises a second terminal of the signal conversion sub-circuit, a second electrode of the capacitor is connected to a first terminal of the signal conversion sub-circuit, the signal conversion sub-circuit is configured to convert the control signal into an intermediate control signal that changes with time, and the capacitor is configured to generate the first control voltage according to the intermediate control signal and the first data voltage, wherein the intermediate control is a triangular wave signal, and a length of the turn-on time of the light-emitting driving circuit is adjusted by adjusting a slope of the triangular wave signal;

wherein the light-emitting control circuit comprises a first light-emitting control transistor and a second light-emitting control transistor, a first electrode of the first light-emitting control transistor is electrically connected to a first power terminal, a second electrode of the first light-emitting control transistor is electrically connected to a first electrode of the driving transistor, and a gate electrode of the first light-emitting control transistor is electrically connected to a light-emitting control line to receive the light-emitting control signal; and a first electrode of the second light-emitting control transistor is electrically connected to the second electrode of the driving transistor, a second electrode of the second light-emitting control transistor is electrically connected to the first terminal of the light-emitting element, and a gate electrode of the second light-emitting control transistor is electrically connected to the light-emitting control line to receive the light-emitting control signal;

the light-emitting control signal is used to control the first light-emitting control transistor and the second light-emitting control transistor to turn on in the light-emitting phase;

wherein the light-emitting element is a light-emitting diode, and a size of the light-emitting diode is less than 100 microns;

the light-emitting phase comprises a first light-emitting phase, a light-emitting time of the light-emitting element in the first light-emitting phase is determined by the first control voltage and the light-emitting control signal;

the light-emitting driving circuit, the capacitor in the storage circuit, and the data writing circuit are formed on a base substrate, the signal conversion sub-circuit is formed on a drive chip, and the drive chip is bonded to the base substrate through a flexible printed circuit board.

* * * * *